US005163513A

United States Patent [19]

Chancey

[11] Patent Number: 5,163,513

[45] Date of Patent: Nov. 17, 1992

[54] CIRCLE THREADFORM FOR MARINE RISER TOP JOINT

[75] Inventor: Roger Chancey, Humble, Tex.

[73] Assignee: Bowen Tools, Inc., Houston, Tex.

[21] Appl. No.: 722,915

[22] Filed: Jun. 28, 1991

[51] Int. Cl.[5] ..... E21B 41/00

[52] U.S. Cl. ..... 166/345; 285/333

[58] Field of Search ..... 166/345, 350, 359, 367; 285/332.4, 333, 334, 36; 403/343

[56] References Cited

U.S. PATENT DOCUMENTS

| | | | |
|---|---|---|---|
| Re. 30,647 | 6/1981 | Blose . | |
| Re. 32,589 | 2/1988 | Goldman et al. . | |
| 138,277 | 4/1873 | Peet . | |
| 597,000 | 1/1898 | Higee . | |
| 1,849,216 | 3/1932 | Adair . | |
| 1,953,095 | 4/1934 | Baker . | |
| 2,181,343 | 11/1939 | Reimschissel . | |
| 2,206,166 | 7/1940 | Dunn . | |
| 2,380,690 | 7/1945 | Graham . | |
| 2,681,815 | 6/1954 | McCarn . | |
| 2,737,033 | 3/1956 | Bendall . | |
| 2,754,134 | 7/1956 | Watts et al. . | |
| 2,822,418 | 2/1958 | Dinnick . | |
| 3,328,052 | 6/1967 | Nilsson . | |
| 3,361,199 | 1/1968 | Haeber et al. | 166/345 |
| 3,645,570 | 2/1972 | Johansson et al. | 285/334 X |
| 3,838,929 | 10/1974 | Burrell . | |
| 3,891,369 | 9/1976 | Bokenkamp . | |
| 3,983,706 | 10/1976 | Kalinowski . | |
| 3,989,284 | 11/1976 | Blose . | |
| 4,004,832 | 1/1977 | Connelly | 285/333 |
| 4,040,756 | 8/1977 | Donegan . | |
| 4,198,179 | 4/1980 | Pease et al. . | |
| 4,212,562 | 7/1980 | Stone et al. . | |
| 4,215,950 | 8/1980 | Stevenson . | |
| 4,226,555 | 10/1980 | Bourne, Jr. et al. . | |
| 4,255,069 | 3/1981 | Yielding . | |
| 4,269,543 | 5/1981 | Goldman et al. . | |
| 4,364,323 | 12/1982 | Stevenson . | |
| 4,379,657 | 4/1983 | Widiner et al. . | |
| 4,389,140 | 6/1983 | Bordes . | |
| 4,395,160 | 7/1983 | deJong . | |
| 4,420,276 | 12/1983 | Roberts . | |
| 4,423,983 | 1/1984 | Dadiras et al. . | |
| 4,473,230 | 9/1984 | Adamek . | |
| 4,479,401 | 10/1984 | Korkut . | |
| 4,505,614 | 3/1985 | Anschutz . | |
| 4,589,799 | 5/1986 | Hotta et al. . | |
| 4,627,768 | 12/1986 | Thomas et al. . | |
| 4,647,254 | 3/1987 | Baugh et al. | 166/345 X |
| 4,661,016 | 4/1987 | Baugh et al. | 166/345 X |
| 4,662,787 | 5/1987 | Tatsuguchi . | |
| 4,688,832 | 8/1987 | Ortloff et al. . | |
| 4,691,791 | 9/1987 | Fillet . | |
| 4,730,857 | 3/1988 | Schwind . | |
| 4,733,991 | 3/1988 | Myers . | |
| 4,759,413 | 7/1988 | Bailey et al. . | |
| 4,773,477 | 9/1988 | Dadiras et al. . | |
| 4,787,778 | 11/1988 | Myers et al. . | |
| 4,790,379 | 12/1988 | Vanderford, Jr. . | |
| 4,818,147 | 4/1989 | Rasmussen . | |
| 4,861,209 | 8/1989 | Larsson . | |
| 4,871,282 | 10/1989 | Jannings . | |
| 4,883,387 | 11/1989 | Myers et al. . | |
| 4,917,409 | 4/1990 | Reeves . | |
| 4,919,460 | 4/1990 | Milberger et al. . | |
| 4,940,087 | 7/1990 | Lien et al. . | |
| 4,943,095 | 7/1990 | Sugimura . | |

*Primary Examiner*—Thuy M. Bui

*Attorney, Agent, or Firm*—Pravel, Gambrell, Hewitt, Kimball & Krieger

[57] ABSTRACT

Disclosed is a circle thread form for threadably engaging the wellhead valve assembly and the riser tensioner to the riser top joint of a marine riser of a floating tension leg platform or similar drilling or production platform. The male thread form is located on the cylindrically shaped riser pipe, wherein the male thread form comprises a series of annular substantially circularly shaped convex protrusions that are substantially equally spaced from one another and extend outwardly from a predetermined pitch line, and between and abutting each of the protrusions a series of annular and substantially circularly shaped concave grooves that extend inwardly from said pitch line. The female thread forms are located on the wellhead valve assembly and the riser tensioner, and comprise a second series of protrusions and grooves, said second grooves shaped complimentary to the pipe protrusions, and the second protrusions shaped to engage the riser pipe grooves no further than about ¾ of the depth into the riser pipe grooves.

11 Claims, 5 Drawing Sheets

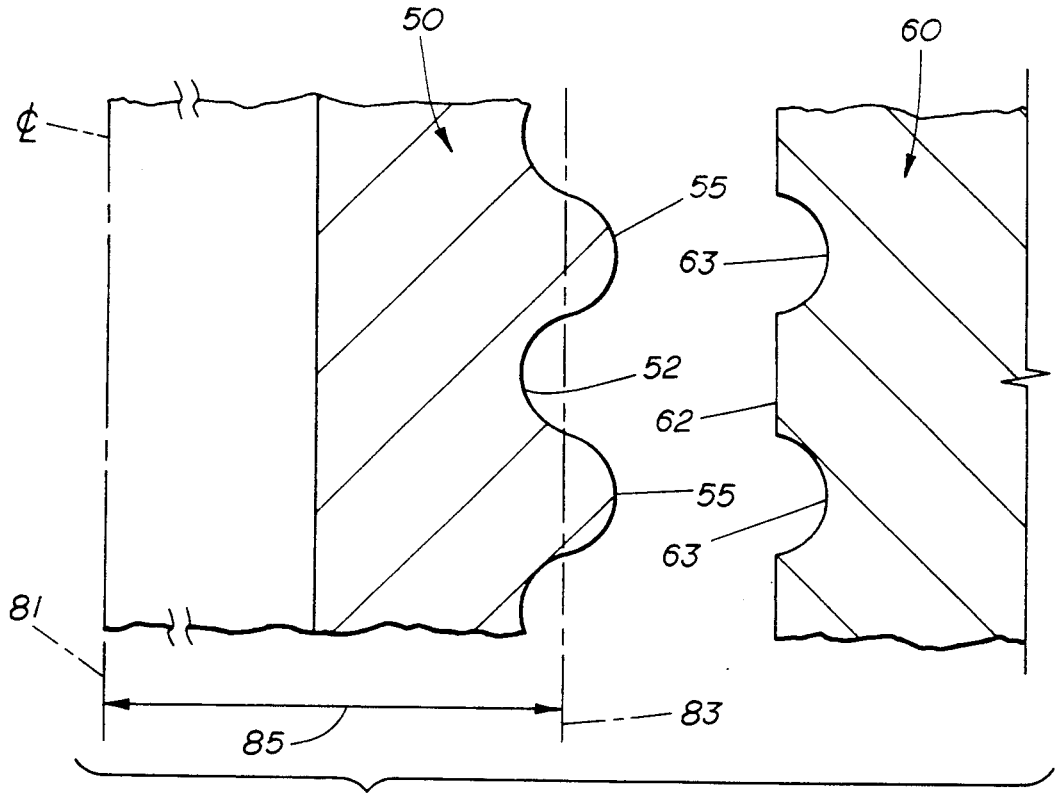
FIG. 7
FIG. 8a
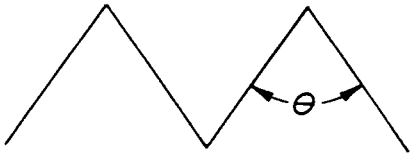
FIG. 8b
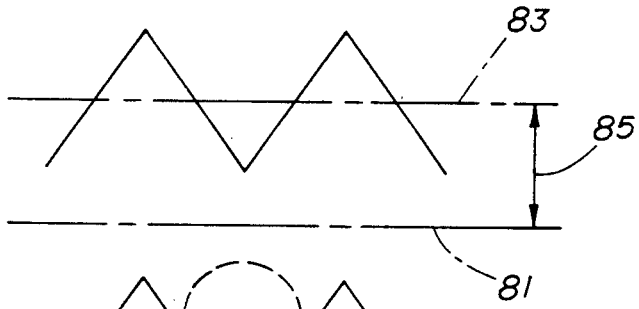
FIG. 8c
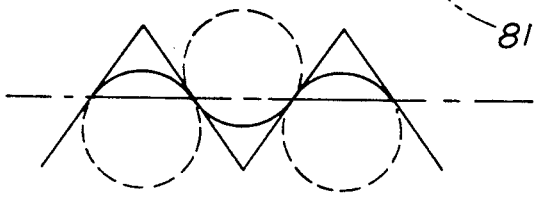
FIG. 8d
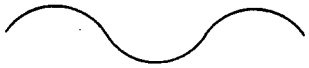

CIRCLE THREADFORM FOR MARINE RISER TOP JOINT

BACKGROUND OF THE INVENTION

1. Field of the Invention

The present invention relates to a method and apparatus for connecting a well on the ocean floor with a wellhead "Christmas" tree, (i.e., the flow control valve assembly) on a fixed or relatively fixed platform, such as a floating tension leg platform, or the like. More particularly, the present invention relates to a riser top joint used in completing such a connection that makes it unnecessary to precisely measure the distance between the well and the wellhead valve assembly. Even more particularly, this invention relates to a threadform design that will withstand high longitudinal stresses to which the riser top joint is subjected.

2. Description of the Related Art

In the exploration and drilling for offshore oil and gas wells, one form of marine structure found to be desirable and effective is the tension leg platform. In this type unit, the working structure is floatably supported by its own buoyancy. However, tension cables applied to the lower end of the platform and fixed to the ocean floor, allow it to be drawn downwardly to a desired working depth to improve stability.

In the drilling of offshore wells, it is necessary to utilize a riser, often referred to as a marine riser, which extends from the well head to the working deck of the floating platform. The riser member is in effect an elongated enclosure which surrounds and protects the drill string, production and/or injection tubing, the oil or gas export riser, as well as pipes which pass from the well upwardly to the platform deck.

Such risers are necessary for normal drilling and/or production operations but are susceptible to damage and in many cases to breakage. The latter results from excessive strain stress to the riser as the floating platform vacillates about its working position in response to excessive wind and wave conditions at the water's surface.

Further, the riser is subjected to a considerable stress induced by water currents and the like which pass around the riser, but which are not particularly effective against the platform. In such an instance the normally vertical riser disposition tends to be distorted as the latter is displaced laterally in one or more directions in response to underwater currents. One of the benefits of a tension leg platform over other floating systems is the very small vertical oscillation that occurs. The structure is less susceptible to natural forces such as wind and waves which would otherwise tend to displace and disturb the horizontal orientation of the platform with respect to the ocean floor. This enables the wellhead valve assembly to be mounted within a few feet of a platform deck without the need for some complex form of motion compensation system. However, the use of a rigid riser system requires a precise measurement between the well on the ocean floor and the deck of the platform, in order to obtain a riser of the necessary length. Such precise measurement becomes increasingly difficult as the water depth moves from hundreds to thousands of feet deep.

The invention disclosed in U.S. Pat. No. 4,733,991 issued Mar. 29, 1988 to Myers is an attempt to alleviate some of the prior art deficiencies. Myers discloses the use of a first series of protrusions on the marine riser top joint to provide a plurality of connecting points for the wellhead tree, and a second series of protrusions on the marine riser top joint to provide a plurality of connecting points for the riser tensioner means.

In the known prior art designs, the protrusions are generally "V" shaped and are sometimes referred to as V-threads. A V-thread protrusion on one piece will fit into the corresponding thread root between two V-thread protrusions on the piece to which it is mated. FIG. 1 is a representative illustration of a marine riser 11 with V-thread protrusions shown generally at 12, mated with a riser tensioner ring upper slip 14 having V-thread protrusions shown generally at 15. FIG. 2 is an enlarged view of V-thread protrusions 14 of upper slip 14. V-thread protrusion 12*a* of marine riser 11 fits into the corresponding thread root 15*b*, between two V-thread protrusions 15*a* of upper slip 14. Likewise, V-thread protrusion 15*a* of upper slip 14 fits into the corresponding thread root 12*b*, between two V-thread protrusions 12*a* of marine riser 11.

In the normal course of operation, the platform is subjected to wave, wind and other forces that impart a high longitudinal force on the riser tensioner connections. Unfortunately, these forces to which the platform is subjected to, can force platform members such as the riser tensioner slip and the marine riser together. If the members are mated together with a V-thread or similar design, the V-thread protrusions from one member act as a wedge in the corresponding thread root between two V-thread protrusions on the mated member, resulting in a high tensile stress area prone to stress cracking. For example, in FIG. 1, as marine riser tensioner lower slip or tensioner ring 18 is forced in the direction of direction arrow 3, the angled saw cut between upper slip 14 and tensioner ring 18, will force upper slip 14 toward marine riser top joint 11. As the V-thread protrusions on marine riser top joint 11 and upper slip 14 are forced into their corresponding thread roots, high tensile stress areas on the marine riser top joint 11 and upper slip 14 develop, referred to generally in FIG. 2 as 12*c* and 15*c* respectively. These areas are prone to developing stress cracks such as stress crack 5.

Generally these high tensile stress areas may be reinforced by making the marine riser top joint 11 and the upper slip 14 thicker at these points. However, this solution tends to increase the size and weight of the member. While such reinforcement is adequate for the upper slip, design considerations limit the degree to which the marine riser may be reinforced. With the marine riser, weight considerations are an important factor. Also, since many pieces of equipment or machinery are sized off of the diameter of the marine riser, it is crucial that the marine riser conform to industry diameter standards. It would be beneficial to provide a thread design which could be utilized in the marine riser that would reduce the stress in the thread roots, and improve the fatigue life of the riser while also minimizing the wall thickness and weight of the marine riser.

Therefore, a need exists in the industry for a lightweight connector for connecting the riser tensioner and wellhead valve assembly to the marine riser that can more adequately withstand the rigors of the longitudinal forces that are generated in the normal course of operation.

SUMMARY OF THE INVENTION

According to the present invention there is provided a new and improved thread form for threadably engaging the wellhead valve assembly and the riser tensioner means to the riser top joint of a marine riser of a floating tension leg platform or similar type of platform. The male thread form is located on the cylindrically shaped riser, wherein the male thread form comprises a series of annular substantially circularly shaped convex protrusions that are substantially equally spaced from one another and extend outwardly from a predetermined pitch diameter, and between and abutting each of the protrusions a series of annular substantially circularly shaped concave grooves that extend inwardly from the pitch diameter. The female thread forms are located on the wellhead tree and the riser tensioner upper slip, and comprise a second series of protrusions and grooves, the second grooves shaped complimentary to the pipe protrusions, and the second protrusions shaped to extend into the pipe grooves no further than about $\frac{3}{4}$ of the depth of the pipe groove.

This thread form of the present invention is also designed for compression loading between the crest of the male thread and the root of the female thread.

BRIEF DESCRIPTION OF THE DRAWINGS

FIG. 7 is a detail view showing male and female thread forms of the present invention.

FIG. 8 (*a–d*) is an illustration showing how the tread forms of the present invention are designed.

DETAILED DESCRIPTION OF THE INVENTION

Figure 1:
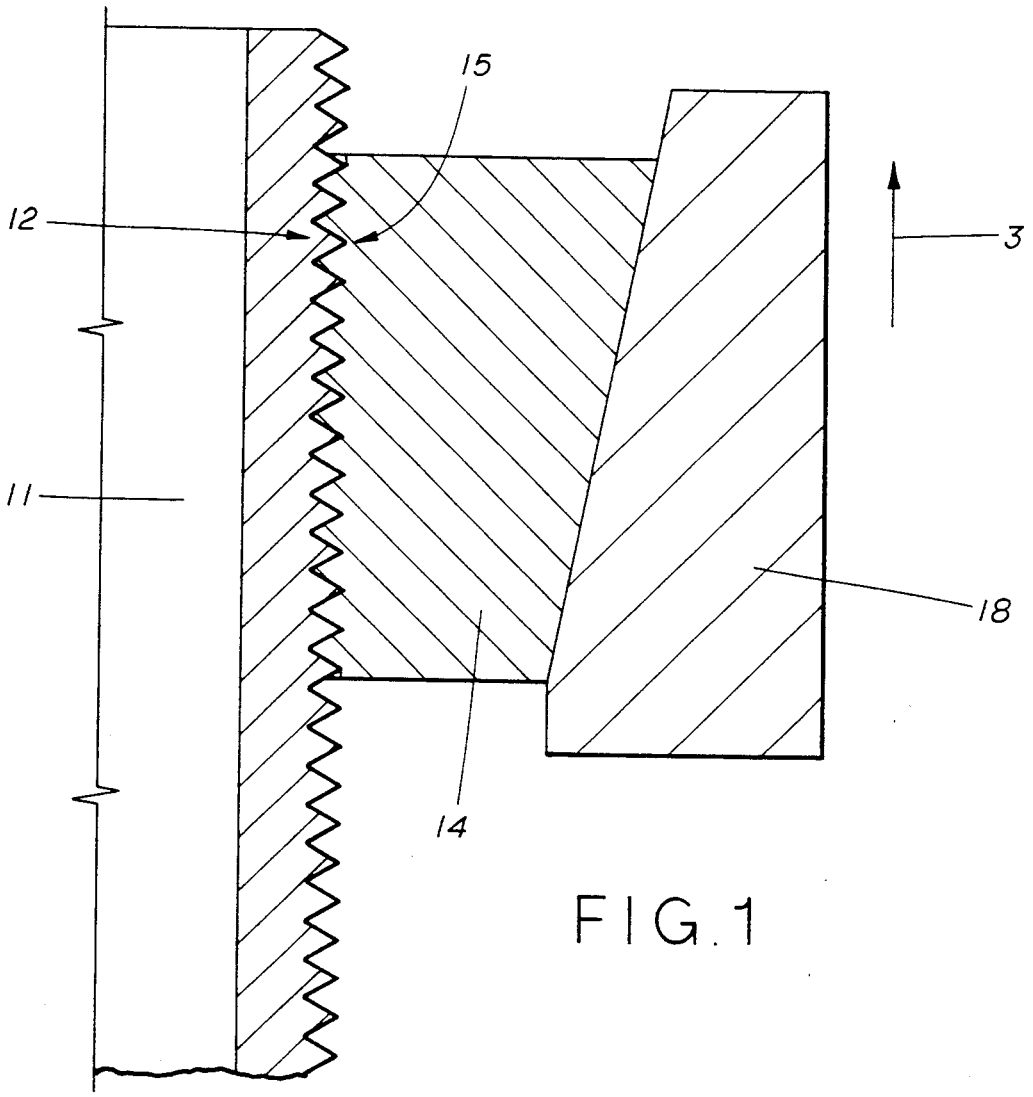
FIG. 1 is a view of a an upper slip forced against a marine riser by a tensioner ring, with a conventional V-thread form utilized.
Figure 2:
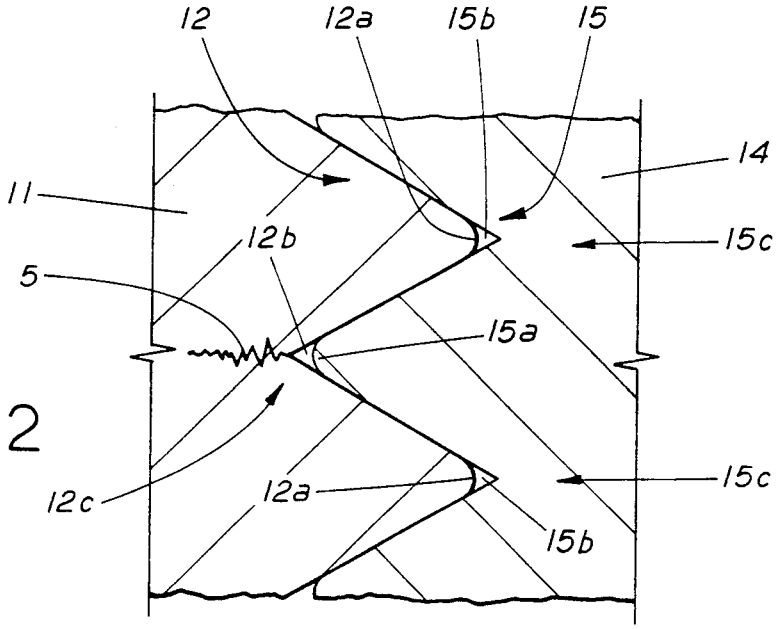
FIG. 2 is an enlarged view of the conventional V-thread form from FIG. 1.
Figure 3:
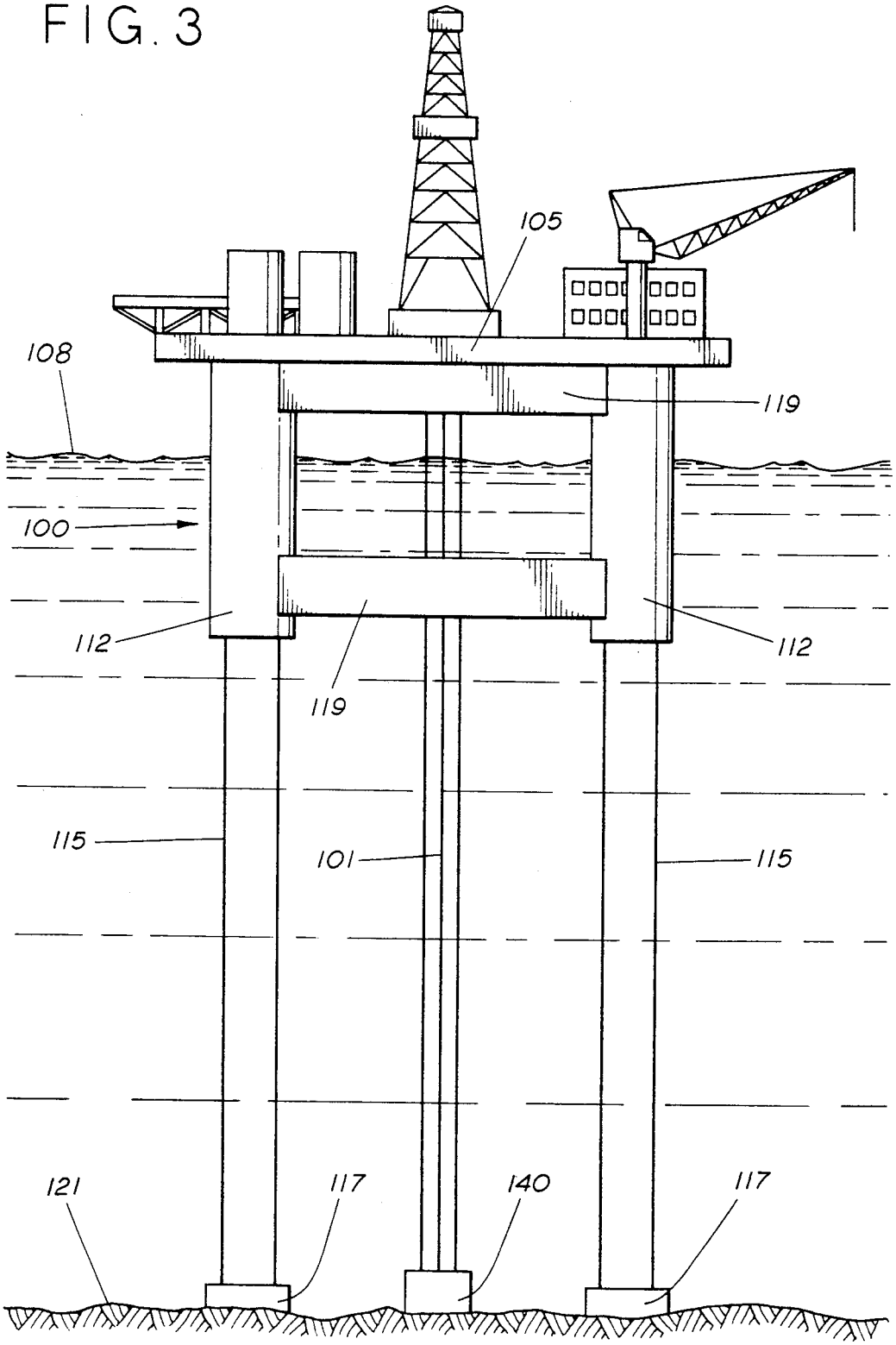
FIG. 3 is a schematic side view of a floating tension leg platform.

Referring to FIG. 3, a floating tension leg platform is shown generally at 100. Floating tension leg platforms of this type have been found to be both practical and desirable for offshore exploration and production of oil and natural gas. Such a platform embodies the advantage of being less susceptible to disruptive forces caused by wind and surface wave conditions, thus assuring continuous operations in most types of weather.

Functionally, floating tension leg platform 100 includes a working deck 105, which is generally positioned in the range of about 50 to 60 feet above water surface 108. While only two are shown, a multiplicity of downwardly extending controllably tensioning members or legs 112 are supportably connected at their upper ends to the platform working deck 105 thereby maintaining the floating tension leg platform at the desired level in the water. The multiplicity of tensioning legs 112 are generally of sufficient tank capacity and are generally connected such that platform working deck 105 may be raised or lowered as desired through the use of a suitable control system, for transporting the structure, positioning it at a working site, or for other operational purposes.

While not shown in great detail, the multiplicity of tensioning legs 112 are further provided with crossbars 119 and other understructure as is necessary to properly stabilize floating tension leg platform 100.

Floating tension leg platform 100 is tethered generally over well template 140 on ocean floor 121 by a multiplicity of tensioning legs or tendons 115. Tendons 115 are connected to the mainstructure of floating tension leg platform 100, generally to a take-up mechanism on working deck 105, and extend downwardly toward and are affixed to anchors 117 which are disposed on ocean floor 121 peripherally around well template 140. Each anchor 117 is firmly embedded into ocean floor 121 by piling or other means. A multiplicity of marine risers 101 extends between the individual wells in well template 140 and platform working deck 105.

Figure 4:
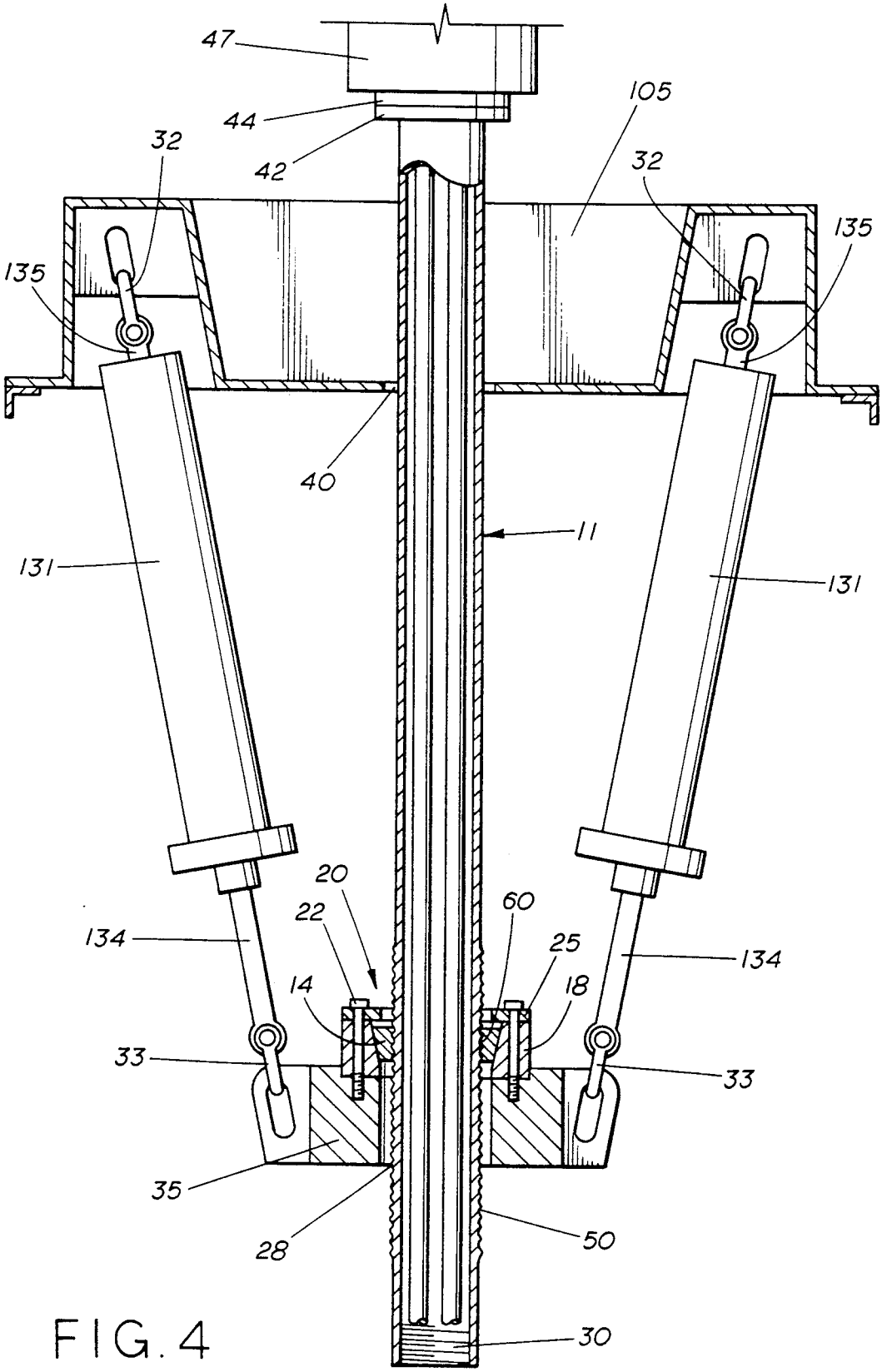
FIG. 4 is side view of a riser top joint showing the platform deck above, the connecting riser tensioners, and the riser tensioner ring.

FIG. 4 shows the riser top joint of the present invention generally at 11. At its upper end, riser top joint 11 extends through opening 40 in platform working deck 105. Riser top joint 11 is connected to wellhead valve assembly 47 with flange 44 on wellhead valve assembly 47 and flange 42 on riser top joint 11. A standard riser joint may be connected to lower end 30 of riser top joint 11 which is internally threaded for such purpose. The thread form utilized at lower end 30 includes straight walled thread, tapered thread, as well as any other thread suitable for connecting riser top joint 11 with a standard riser joint.

Riser tensioners 131 (only two shown but generally any number may be used) extend downwardly from deck 105 to the tensioner ring 35. Arms 134 of riser tensioners 131 are connected to the tensioner ring 35 by a connecting means 35. In the embodiment shown, the connecting means 33 is a shackle, although other connecting means that are known in the art such as a modified ball and socket joint, could be utilized. The connecting means 33 will permit some movement between the riser tensioners 131 and the tensioner ring 35 that will occur as the arms 134 of riser tensioners 131 extend and retract to maintain a uniform tension on the riser 101. Similar connecting means 32 are utilized in connecting the upper ends 135 of riser tensioners 131 to the platform working deck 105, to allow for the same type of movement between riser tensioners 131 and platform working deck 105.

Tensioner ring 35 is affixed to the riser top joint 11 along circle threads 50 by a conventional slip mechanism shown generally at 20, which is connected to riser top joint 11 by a multiplicity of security bolts 22. Throughbore 28 on tensioner ring 35 is of sufficient diameter to admit the riser top joint 11. Tensioner ring 35 may be of unitary design, as shown in FIG. 4, or it may be a split segment tensioner ring.

Slip mechanism 20 generally comprises camming ring 18, upper slip 14 having circle threads 60 and a clamping plate 25. In operation, camming ring 18 forces upper slip 14 into engagement with circle threads 50, while clamping plate 25 holds upper slip 14 in the engaged position. A lateral pin (not shown) may be utilized to prevent relative rotation between camming ring 18 and upper slip 14 and, hence, between tensioner ring 35 and top joint 11.

Figure 5:
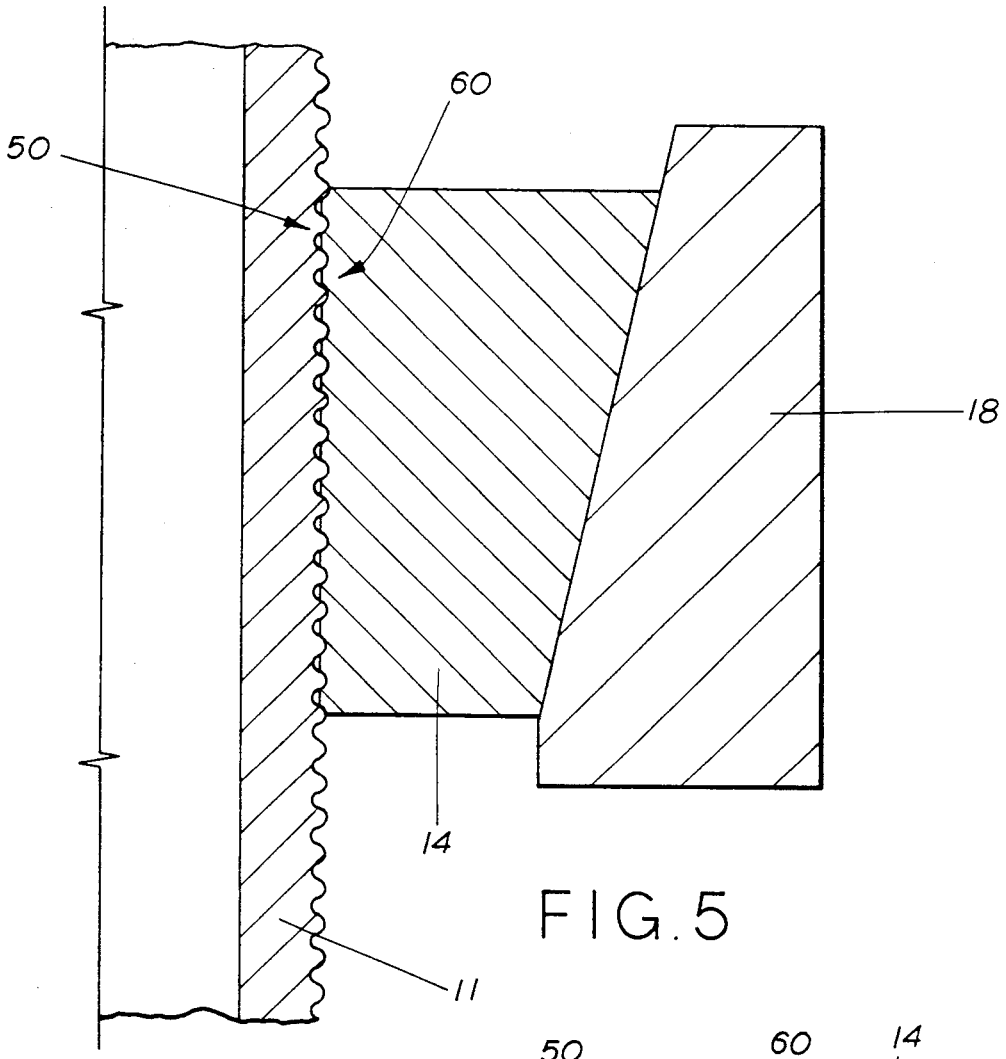
FIG. 5 is a view of a an upper slip forced against a marine riser by a tensioner ring, with the thread form of the present invention utilized.

FIG. 5 is a detail drawing showing male circle threads 50 on riser top joint 11 and the corresponding female threads 60 on upper slip 14. As tensioning ring 18 is forced upward, upper slip 14 is forced toward riser top joint 11, thereby forcibly engaging cooperating circle threads 50 and 60. To allow for the vertical adjustment of upper slip 14, the circle thread form may be in helical spiral form.

Figure 6:
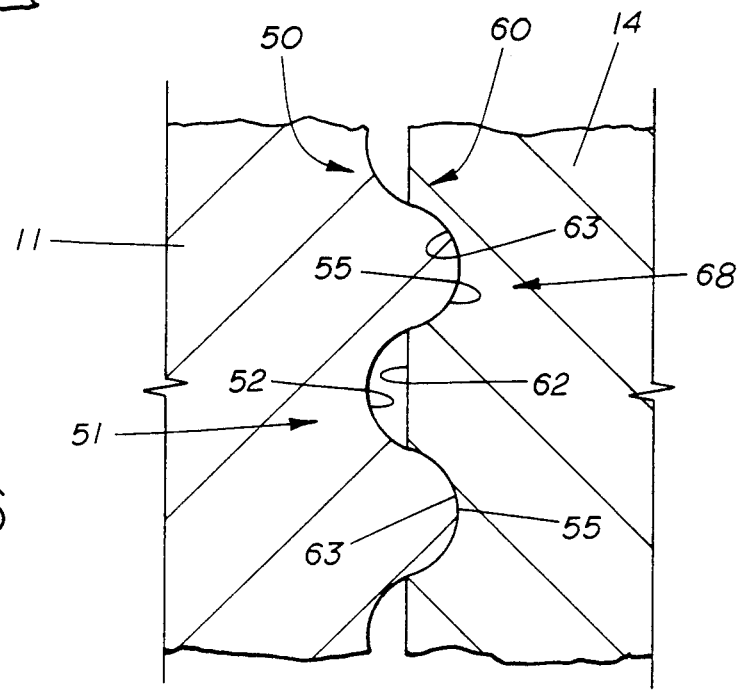
FIG. 6 is an enlarged view of the thread form of the present invention as shown in FIG. 5.

FIG. 6 is an enlarged view of the cooperating circle threads 50 and 60. Although male thread crest or protrusions 55 fully engages female thread root 63, tensile stress in area 68 is minimized because circularly shape male thread crest 55 tends to function as a radial load transfer mechanism. Furthermore, in the area generally at 51, tensile stress is also minimized because female crest or protrusion 62 does not fully engage male thread root 55.

Male circle thread form 50 of the present invention, and female circle thread form 60 of the present invention may be better understood by reference to FIG. 8, which shows the geometry of the circle thread forms. FIG. 8*a* shows a saw tooth thread form pattern. Angle 8 is in the range of about 60° to about 120°. FIG. 8*b* shows the center line 81 of the thread member. A pitch line 83 extends through the saw tooth pattern. Pitch radius 85 is the distance between the pitch line 83 and center line 81.

In FIG. 8*c* circles are drawn as shown that are tangent to the saw tooth pattern at the points at which the pitch line intersects the saw tooth pattern. The smaller circle segments that are concave toward the pitch line comprise the male circle thread form, as shown in FIG. 8*d*. Although the pitch line 83 is shown intersecting the saw cut pattern halfway between the crest and root of the saw cut pattern, it may intersect at other points.

Once the male circle thread form is created, the female circle thread form is relatively easy to design. FIG. 7 shows male circle thread form 50 relative to pitch line 83 and center line 81. The female circle thread root 63 must be shaped to receive the male circle thread crest 55, and its shape is complementary to the shape of the male circle thread crest 55. The female circle thread root 63 must be designed to receive and engage at least enough of the male circle thread crest as is necessary to prevent camming ring 18 from moving upper slip 14. Generally, depending on the saw cut angle between upper slip 14 and camming ring 18, and the coefficient of friction at the various contact points, the female circle thread root 63 must at least receive and fully engage in the range of at least about the top $\frac{1}{4}$ to about the top $\frac{3}{4}$ of the male circle thread crest 55, to prevent upper slip 14 from slipping relative to riser 11.

The particular geometry of the female circle thread crest 62 is generally unimportant as long as it helps to reduce high tensile stress in riser 11. Thus while it may extend into the male circle thread root 52 further, the female circle thread crest 62 must be designed to engage the male circle thread root 52 no further than about $\frac{2}{3}$ to $\frac{3}{4}$ of the way into male circle thread root 52. Preferably, the female circle thread crest 62 is designed to engage the male circle thread root 52 no further than about $\frac{1}{2}$ of the way into male circle thread root 52.

While the present circle thread form has been illustrated with the male circle thread form on the riser top joint, and the female circle thread form on the upper slip, it is understood that the male and female threads may be interchanged. Likewise, while the circle thread of the present invention is shown as a means for connecting the riser top joint and the upper slip, it may also be used to connect other two members together. For example, the wellhead tree may be connected to the riser top joint with the circle thread form of the present invention.

It can be seen that the above illustrated thread form will provide for a lower stress concentration factor in the male circle thread roots in or near the vicinity of the engagement of the female circle threads than conventional connection means.

The foregoing disclosure and description of the invention are illustrative and explanatory thereof, and various changes in the size, shape and materials, as well as the details of the illustrated construction may be made without departing from the spirit of the invention.

I claim:

1. A riser tensioner apparatus for connecting a riser tensioner to a riser pipe for adjustably positioning a wellhead valve assembly in a fixed location relative to a well on an ocean floor while permitting relative movement between the fixed wellhead valve assembly and a deck of a floating platform above which said wellhead valve assembly is mounted, and wherein the deck has an upper surface and a lower surface, comprising:

a riser pipe extending through an opening in the deck of the platform from a point above said upper surface to a point below said lower surface;

a first connection means on the riser pipe above the upper surface of the deck for connecting the wellhead valve assembly to the riser pipe above the upper surface of the deck;

a second connection means on the riser pipe below the lower surface of the deck for connecting the riser pipe to the riser tensioner;

said second connection means including a series of annular substantially circularly shaped protrusions on the riser pipe that are substantially equally spaced from one another and extend outwardly from a predetermined pitch line;

said second connection means each also having between and abutting each of the protrusions, a series of annular substantially circularly shaped concave grooves that extend inwardly from the pitch line.

2. The apparatus of claim 1 wherein the riser tensioner comprises for threadably engaging said second connection means for connecting the riser tensioner, a series of protrusions and grooves, said riser tensioner grooves shaped complimentary to the riser pipe protrusions, and the riser tensioner protrusions shaped to engage the riser pipe grooves no further than about $\frac{3}{4}$ of the depth into the riser pipe grooves.

3. The apparatus of claim 1 wherein the protrusions on the riser pipe are in the form of a continuous spiral permitting continuous adjustability of the riser tensioner.

4. The apparatus of claim 1 wherein the first connection means for connecting the wellhead valve assemble comprises a series of annular substantially circularly shaped convex protrusions that are generally equally spaced from one another and extend outwardly from the pitch line, and having between and abutting each of the protrusions a series of annular substantially circularly shaped concave grooves that extend inwardly from the pitch line.

5. The apparatus of claim 4 wherein the wellhead valve assembly comprises for threadably engaging said first connection means for connecting the valve assembly, a series of protrusions and grooves, with the wellhead valve assembly grooves shaped complimentary to the pipe protrusions, and the wellhead valve assembly protrusions shaped to engage the pipe grooves no further than about $\frac{3}{4}$ of the depth into the pipe grooves.

6. The apparatus of claim 4 wherein the protrusions on the pipe are in the form of a continuous spiral permitting continuous adjustability of the riser tensioner.

7. A riser tensioner apparatus for connecting a riser tensioner to a riser pipe for adjustably positioning a wellhead valve assembly in a fixed location relative to a well on an ocean floor while permitting relative movement between the fixed wellhead valve assembly and a deck of a floating platform above which said wellhead valve assembly is mounted, and wherein the deck has an upper surface and a lower surface, comprising:

a riser pipe extending through an opening in the deck of the platform from a point above said upper surface to a point below said lower surface;

a first connection means on the riser pipe above the upper surface of the deck for connecting the wellhead valve assembly to the riser pipe above the upper surface of the deck;

a second connection means on the riser pipe below the lower surface of the deck for connecting the riser pipe to the riser tensioner;

said first connection means including a series of annular substantially circularly shaped protrusions on the riser pipe that are substantially equally spaced from one another and extend outwardly from a predetermined pitch line;

said first connection means each also having between and abutting each of the protrusions, a series of annular substantially circularly shaped concave grooves that extend inwardly from the pitch line.

8. The apparatus of claim 7 wherein the wellhead valve assembly comprises for threadably engaging said first connection means for connecting wellhead valve assembly, a series of protrusions and grooves, said wellhead valve assembly grooves shaped complimentary to the riser pipe protrusions, and the wellhead valve assembly protrusions shaped to engage the riser pipe grooves no further than about $\frac{3}{4}$ of the depth into the riser pipe grooves.

9. The apparatus of claim 7 wherein the protrusions on the riser pipe are in the form of a continuous spiral permitting continuous adjustability of the wellhead valve assembly.

10. A thread form for forming a threaded connection comprising:

a male member having a male thread form comprising a series of annular substantially circularly shaped protrusions on the male member that are substantially equally spaced from one another and extend outwardly from a predetermined pitch line, and having between and abutting each of the protrusions, a series of annular substantially circularly shaped concave grooves that extend inwardly from the pitch line; and, a female member having a female thread form for threadably engaging said male thread form connection comprising a series of protrusions and grooves, with the female thread form grooves shaped complimentary to the pipe protrusions, and the female thread form protrusions shaped to engage the male thread form grooves no further than about $\frac{3}{4}$ of the depth into the male thread form grooves.

11. The apparatus of claim 10 wherein the threaded connection forms a continuous spiral permitting continuous adjustability of the male and female member.

* * * * *